US008376243B2

(12) United States Patent
Cloutier

(10) Patent No.: US 8,376,243 B2
(45) Date of Patent: Feb. 19, 2013

(54) BOILER WITH AN ADJACENT CHAMBER AND AN HELICOIDAL HEAT EXCHANGER

(75) Inventor: Louis Cloutier, Richmond (CA)

(73) Assignee: Gestion M.J.P.A. Inc., Richmond (CA)

( * ) Notice: Subject to any disclaimer, the term of this patent is extended or adjusted under 35 U.S.C. 154(b) by 1147 days.

(21) Appl. No.: 11/910,841

(22) PCT Filed: Apr. 6, 2006

(86) PCT No.: PCT/CA2006/000539
§ 371 (c)(1),
(2), (4) Date: Oct. 5, 2007

(87) PCT Pub. No.: WO2006/105668
PCT Pub. Date: Oct. 12, 2006

(65) Prior Publication Data

US 2008/0191046 A1 Aug. 14, 2008

(30) Foreign Application Priority Data

Apr. 7, 2005 (CA) ..... 2503056

(51) Int. Cl.
*F24H 1/34* (2006.01)
*F24H 1/00* (2006.01)
*F24H 1/08* (2006.01)
*F24H 1/18* (2006.01)

(52) U.S. Cl. ..... 237/19; 237/8 A; 237/56; 237/59; 237/61; 237/62; 122/18.1; 122/15.1; 122/235.11; 122/235.23; 122/247

(58) Field of Classification Search ..... 237/19, 237/8 A, 8 B, 56, 57, 59, 61, 62, 63; 122/18.1, 122/18.2, 15.1, 235.11, 235.23, 247; *F24H 1/00, 1/08, 1/18*
See application file for complete search history.

(56) References Cited

U.S. PATENT DOCUMENTS

| | | | | |
|---|---|---|---|---|
| 324,120 A | | 8/1885 | Kirkaldy | |
| 1,199,499 A | * | 9/1916 | Rockman | 126/363.1 |
| 1,611,764 A | * | 12/1926 | Mendelson | 165/76 |
| 1,630,890 A | * | 5/1927 | Coates | 122/32 |
| 2,126,552 A | | 8/1938 | Holloway | |

(Continued)

FOREIGN PATENT DOCUMENTS

| | | |
|---|---|---|
| CA | 1097546 A1 | 3/1981 |
| CA | 2249910 A1 | 4/2000 |

(Continued)

*Primary Examiner* — Steven B McAllister
*Assistant Examiner* — Daniel E Namay
(74) *Attorney, Agent, or Firm* — Foley & Lardner LLP

(57) ABSTRACT

Disclosed is a boiler for providing hot water to a heating system of a building and for simultaneously producing hot domestic water. This boiler comprises a heating tank provided with a water inlet and a water outlet through which water for use in the heating system circulates and an adjacent chamber annexed to the heating tank. This adjacent chamber is in direct communication with the heating tank and containing means for heating the water. The boiler also comprises a heat exchanger provided with a water inlet and a water outlet through which circulates the domestic water. This heat exchanger is made of a plurality of tubular coils of helicoidal shape that are located within the heating tank in order to allow heat transfer between the hot water within the heating tank and the domestic water that circulates within the tubular coils.

20 Claims, 7 Drawing Sheets

U.S. PATENT DOCUMENTS

| | | | | | |
|---|---|---|---|---|---|
| 2,167,695 | A | * | 8/1939 | Stewart | 236/9 A |
| 2,211,573 | A | * | 8/1940 | McGrath | 237/8 R |
| 2,458,826 | A | | 1/1949 | Blumberg et al. | |
| 2,485,689 | A | | 10/1949 | Baumann | |
| 2,693,346 | A | | 11/1954 | Petersen | |
| 3,171,597 | A | * | 3/1965 | Baier | 237/19 |
| 3,237,608 | A | * | 3/1966 | Brandl | 122/33 |
| 3,882,693 | A | | 5/1975 | Hiller | |
| 4,210,102 | A | * | 7/1980 | Dosmann | 122/20 B |
| 4,242,569 | A | * | 12/1980 | Kayser | 392/358 |
| 4,265,094 | A | | 5/1981 | Haasis, Jr. | |
| 4,296,883 | A | | 10/1981 | Yanna | |
| 4,316,501 | A | | 2/1982 | Bowden et al. | |
| 4,417,546 | A | * | 11/1983 | Hoskinson | 122/20 B |
| 4,469,935 | A | | 9/1984 | Candela | |
| 4,633,820 | A | * | 1/1987 | Montini | 122/37 |
| 4,643,212 | A | | 2/1987 | Rothrock | |
| 4,699,091 | A | * | 10/1987 | Waters | 122/20 A |
| 4,880,157 | A | * | 11/1989 | Boot et al. | 236/25 R |
| 5,165,472 | A | | 11/1992 | Cloutier | |
| 5,165,596 | A | | 11/1992 | Le Mer | |
| 5,288,413 | A | | 2/1994 | Chu | |
| 5,361,751 | A | * | 11/1994 | Biggs | 126/101 |
| 5,372,185 | A | * | 12/1994 | Lannes | 122/18.31 |
| 5,485,879 | A | * | 1/1996 | Lannes | 122/18.31 |
| 5,571,476 | A | * | 11/1996 | Newman | 422/26 |
| 6,075,923 | A | * | 6/2000 | Wu | 392/451 |
| 6,202,935 | B1 | * | 3/2001 | Akkala et al. | 237/19 |
| 6,701,874 | B1 | * | 3/2004 | Schultz et al. | 122/14.2 |
| 6,860,430 | B2 | * | 3/2005 | Sanchez | 236/11 |
| 6,938,581 | B2 | * | 9/2005 | Neeser et al. | 122/20 R |
| 7,028,490 | B2 | * | 4/2006 | Tomlinson | 62/115 |
| 7,032,542 | B2 | * | 4/2006 | Donnelly et al. | 122/14.2 |
| 7,114,468 | B1 | * | 10/2006 | Homan | 122/4 A |
| 7,117,825 | B2 | * | 10/2006 | Phillips | 122/4 A |
| 7,810,456 | B2 | * | 10/2010 | Kobayashi | 122/31.1 |
| 2004/0079749 | A1 | * | 4/2004 | Young et al. | 219/486 |
| 2004/0200905 | A1 | * | 10/2004 | Saitoh et al. | 237/19 |
| 2005/0077368 | A1 | * | 4/2005 | Zak et al. | 237/19 |
| 2009/0090788 | A1 | * | 4/2009 | Roques | 236/20 R |

FOREIGN PATENT DOCUMENTS

| | | |
|---|---|---|
| CA | 2 038 520 C | 1/2002 |

* cited by examiner

BOILER WITH AN ADJACENT CHAMBER AND AN HELICOIDAL HEAT EXCHANGER

FIELD OF THE INVENTION

The present invention relates to a boiler that provides hot water to a heating system of a building while simultaneously producing hot domestic water within a same unit.

More precisely, the invention relates to a boiler with an adjacent chamber and a helicoidal heat exchanger that permits to carry out the above-mentioned actions.

BRIEF DESCRIPTION OF THE PRIOR ART

Presently, the heating systems that make use of hot water, are supplied by boilers operated with electricity, oil or gas. Diffusion of heat within the building to be heated can be carried out with different types of equipment, such as fan-coils, cast-iron heaters, floor heating tubings or finned tubes. The circulation of hot water within the building is carried out in a closed circuit by means of a circulation pump, which explains why use is preferably made of the expression "boiler " instead of "water heater", the latter system by definition being used only for heating water for external use and not for use in a closed circuit.

Sometimes, in addition to the energy source used for heating the building, the boiler provides sufficient energy for producing domestic hot water, either by using an independent water heater like the one sold under the trademark OPTIMIZER/TURBOMAX, or by addition of a tankless-type coil within the water heater.

The combination of a boiler with an indirect water heater is interesting in that it permits to produce a high amount of hot water and thus to respond to residential, commercial and institution needs. In this type of combination, the boiler acts at the source of energy and the indirect water heater as a heat exchanger.

Two types of independent water heater presently exist on the market.

In the first one, the heating water circulates through an exchange coil within the tank which contains the domestic water. In the second type of water heater, the domestic water circulates through the coil within the tank which contains the heating water. Such corresponds to OPTIMIZER/TURBOMAX mentioned hereinabove. However, this type of equipment requests the installation of two distinct pieces of equipment.

The second type of indirect water heater mentioned hereinabove wherein a tankless coil is inserted within the tank, is interesting in that it responds to residential need but with small water flow. However, it has some difficulties in satisfying needs where a higher water flow is required such as the one requested for fill up a bath. Indeed, this kind of system has a small thermal mass and the coil, due to its shape and position, is unable to pick up 100% of the energy requested from the thermal mass of the boiler.

SUMMARY OF THE INVENTION

The object of the present invention is to provide a boiler for providing hot water to a heating system of a building and for simultaneously producing hot domestic water. This boiler comprising:

a heating tank provided with a water inlet and a water outlet through which water for use in the heating system circulates;

an adjacent chamber annexed to the heating tank, said adjacent chamber being in communication with the heating tank and containing means for heating the water within the heating tank; and a heat exchanger provided with a water inlet and a water outlet through which circulates the domestic water, said heat exchanger comprising a plurality of tubular coils of helicoidal shape that are located within the heating tank in order to allow heat transfer between the hot water within the heating tank and the domestic water that circulates within the tubular coils.

This boiler also comprises:

an adjacent chamber annexed to the heating tank, said adjacent chamber being in direct communication with the heating tank and containing said means for heating the water.

Preferably:

the water inlet of the heating tank is provided with an injector devised for (i) injecting part of the water to be heated into the adjacent chamber in order to create within said adjacent chamber a turbulence and thus to ensure heat transmission from the adjacent chamber toward the heating tank, (ii) ensuring uniform diffusion of water within the heating tank and (iii) generating turbulences of said water within the heating tank around the tubular coils;

the water outlet of the heating tank is provided with a receiver;

the heat exchanger extends over almost all of the height of the heating tank in order to get maximum energy by heat transfer; and the adjacent chamber is located in a lower part of the heating tank to take advantage of natural convection within said heating tank.

DETAILED DESCRIPTION OF THE INVENTION

As indicated hereinabove, the object of the present invention is to provide a boiler that permits to simultaneously heat a building while producing domestic water in a large amount within one single piece of equipment.

This boiler comprises a heating tank which is provided with an adjacent chamber and is filled up with water at low pressure. A low pressure circuit provided with a circulation pump supplies the heating equipment of the building with circulating water heated within the heating tank through said heating equipment that may consist of fan-coils, gas-iron heaters, floor heating tubings or finned tubes. The production of domestic hot water is ensured by energy transfer between the water heated within the heating tank and a heat exchanger comprising a plurality of tubular coils of helicoidal shape that are positioned in such a manner as to pick up 100% of the energy of the heating tank. Heating means. also called hereinafter "energy source", are installed within the adjacent chamber of the heating tank. These heating means are chosen so as to provide sufficient energy to produce the requested amount of heating water and domestic hot water.

Since the heating tank is always filled up with heating water circulating in a closed circuit, there is no corrosion within said tank. Indeed, after a few hours, the oxygen contained in the heating water, when the boiler is started, is eliminated and the non-oxygenated water remains within the system year after year without creating corrosion within the same. This gives a long lifetime to the generator.

The water inlet and water outlet of the heating tank of the boilers are provided with injectors like those forming the subject matter of Canadian patent No. 2,038,520. Such ensures uniform diffusion of the heating water within the heating tank when the circulation pump is in operation, thereby generating heating water turbulence all around the tubular coils. Such also improves thermal exchange while eliminating stagnant zones or cold water passages which could otherwise be formed.

The presence of heating water within the heating tank permits to keep the generator efficient for a long period of time contrary to what is achieved with the conventional water heaters or boilers used as "booster". Indeed, the heating water does not contain sediments and chalk contrary to the domestic water. Thus, there are no scale deposits onto the external walls of the exchanger or on the hot surfaces of the energy generator (electrical elements, gas exchanger, burners), contrary to what occurs with the conventional systems. Since the scale deposits act as an insulating material and reduce the heat transfer, the efficiency of the boiler according to the invention will be much higher than the one of the conventional systems over the time.

As mentioned hereinabove, in order to transfer energy for the production domestic hot water, the heat exchanger according to the invention comprises a plurality of tubular coils made of copper. Such also permits to avoid any corrosion with domestic water, since copper has a timelife of more than 50 years.

The heat exchanger advantageously has such a shape and position as to allow picking up the maximum of energy from the thermal mass of the heating tank. As already mentioned hereinabove, the heat exchanger comprises a plurality of tubular coils of helicoidal shape which are advantageously located in a compact and circular manner in order to pick up energy within the whole cylinder of the heating tank. Advantageously also, the heat exchanger extends over all the height of the heating tank and is provided with a domestic coil water inlet which is located in the bottom of the heating tank, and with a domestic hot water outlet which is located in the upper part of the heating tank.

The helicoidal shape of the tubular coils made of copper has the advantage of favorizing turbulence of domestic water within the same. This increases thermal exchange between the heating water and the domestic water and reduces the accumulation of scale deposits within the coils. The helicoidal shape of the coils also permits to generate a contraction in dilatation of the material in a radial manner, which also reduces the accumulation of scale deposits.

As mentioned hereinabove, the energy source required for providing the necessary heat to respond to the heating requirement is located within the adjacent chamber annexed to the heating tank. This adjacent chamber is in direct communication with the heating tank which communicates its energy via openings made in it. This adjacent chamber is actually located in the lower part of the heating tank. By positioning the energy source in the adjacent chamber, it is possible to use a heat exchanger made of several tubular coils that extend within the whole volume of the heating tank, and are not only positioned in the upper part of it. Such increases the thermal exchange up to 100% of the thermal mass, contrary to what is achieved with heating generator which have a tankless and do not permit to pick up the maximum energy from the heating tank. Indeed, the tankless used to heat the domestic water is located only in the upper part of the boiler.

In practice, the energy of the adjacent chamber is transmitted to the heating tank by the openings made therein when the circulation pump is in operation, or by natural convection. Such creates turbulence and ensures transmission of heat from the adjacent chamber towards the heating tank.

The fact that the adjacent chamber is positioned on a lower side of the heating tank permits, when the circulation pump is stopped, to ensure natural convection within the heating tank, in the same way as a heating element under a window. This natural convection provides more uniform temperature between the bottom and top of the heating tank when the pump is stopped and the energy source is still in operation, contrary to what happens in a conventional water heater. Moreover, the energy source can be of different types: electricity, oil, gas or solar panels.

The boiler according to the invention can be used with a by-pass that circulates the heating water between the top and the bottom of the heating tank. When there is a request for domestic hot water and the heating water is stagnant (no by-pass), about 70% of the energy within the tank is transmitted to the domestic water before the heating elements are switched on, since the temperature probes of the elements are located in the upper part of the boiler and the water entering the same (at the bottom of the heating tank) is colder than the water at the top of the heating tank. This is the same with a conventional electric boiler. According to the invention, in order to improve the reaction time and increase production of domestic hot water, a temperature probe can be located in a lower part of the heating tank. When there is need for domestic hot water, this temperature probe starts the pump of the by-pass, pumping the water from the bottom of the heating tank towards the top of this tank, and starting the electrical elements faster. Such thus permits increase of the production of domestic hot water.

It is worth mentioning that, in practice, the heating tank of the boiler according to the invention could be used for other purposes, such as storing energy in order to use it only when necessary, especially when the energy costs vary depending on the period of the day. The energy could then store in the water or any other material that may be subject to phase change.

The invention and its advantages will be better understood upon reading the following non-limitative description that follows of a preferred embodiment thereof.

DESCRIPTION OF A PREFERRED EMBODIMENT

Figure 1:
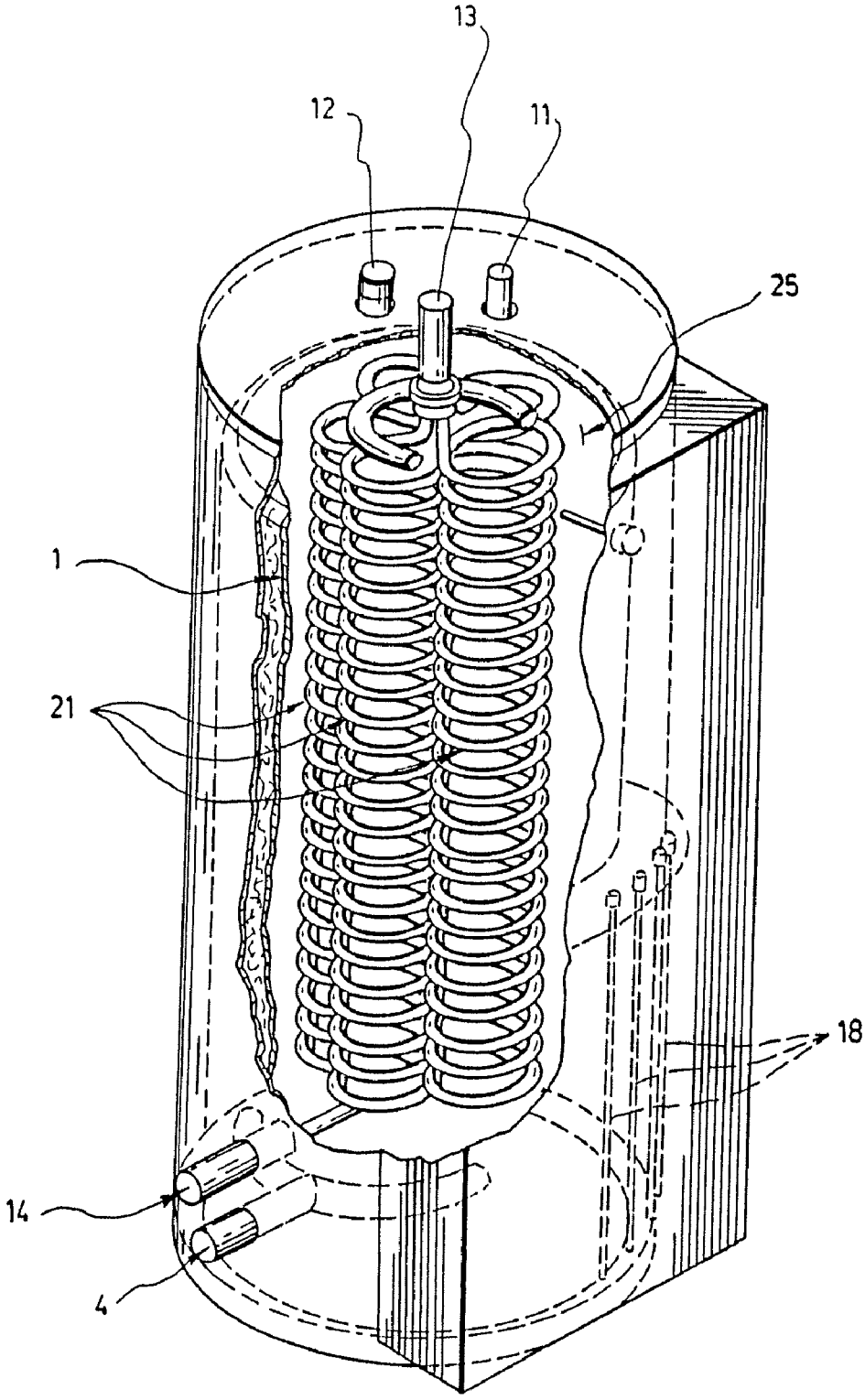
FIG. 1 is an open perspective view of a boiler with a heating tank, an adjacent chamber and an helicoidal heat exchanger according to the preferred embodiment of the invention.
Figure 2:
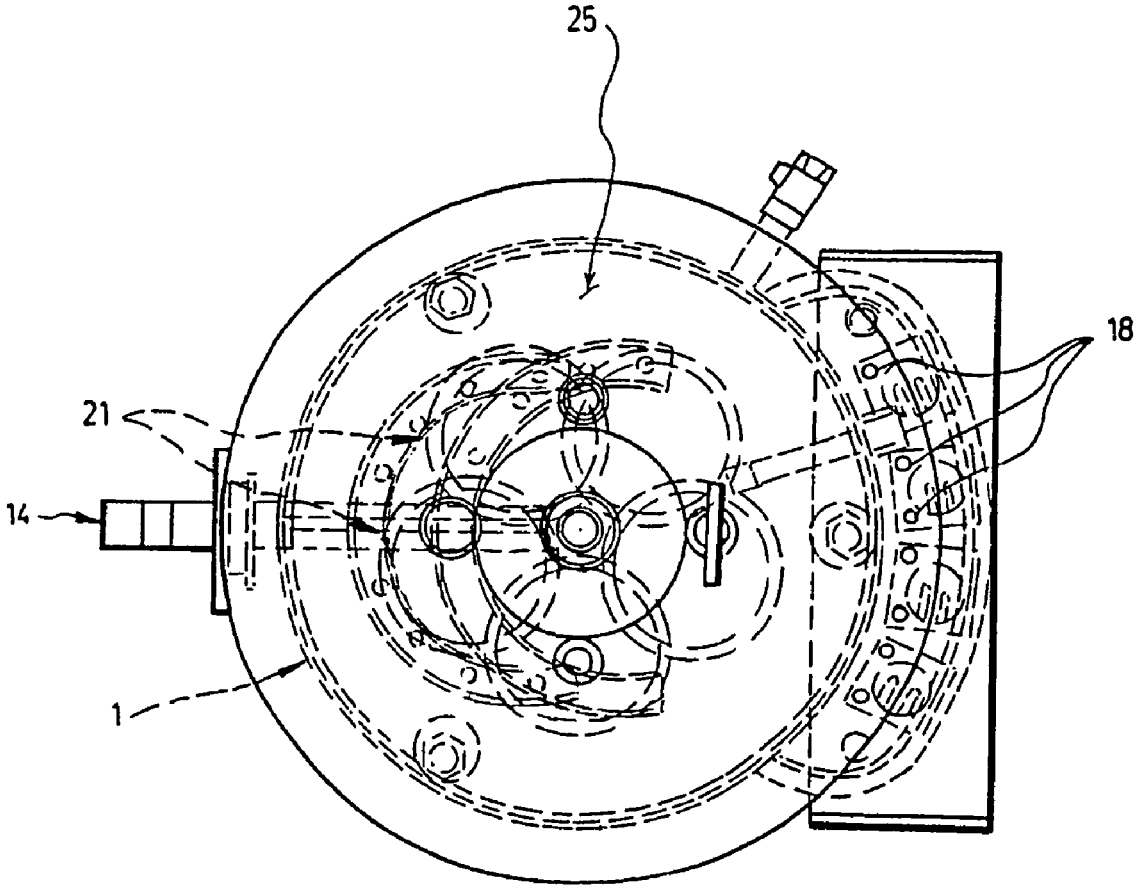
FIGS. 2, 3 and 4 are open top, front and side views respectively, of the boiler shown in FIG. 1.
Figure 3:
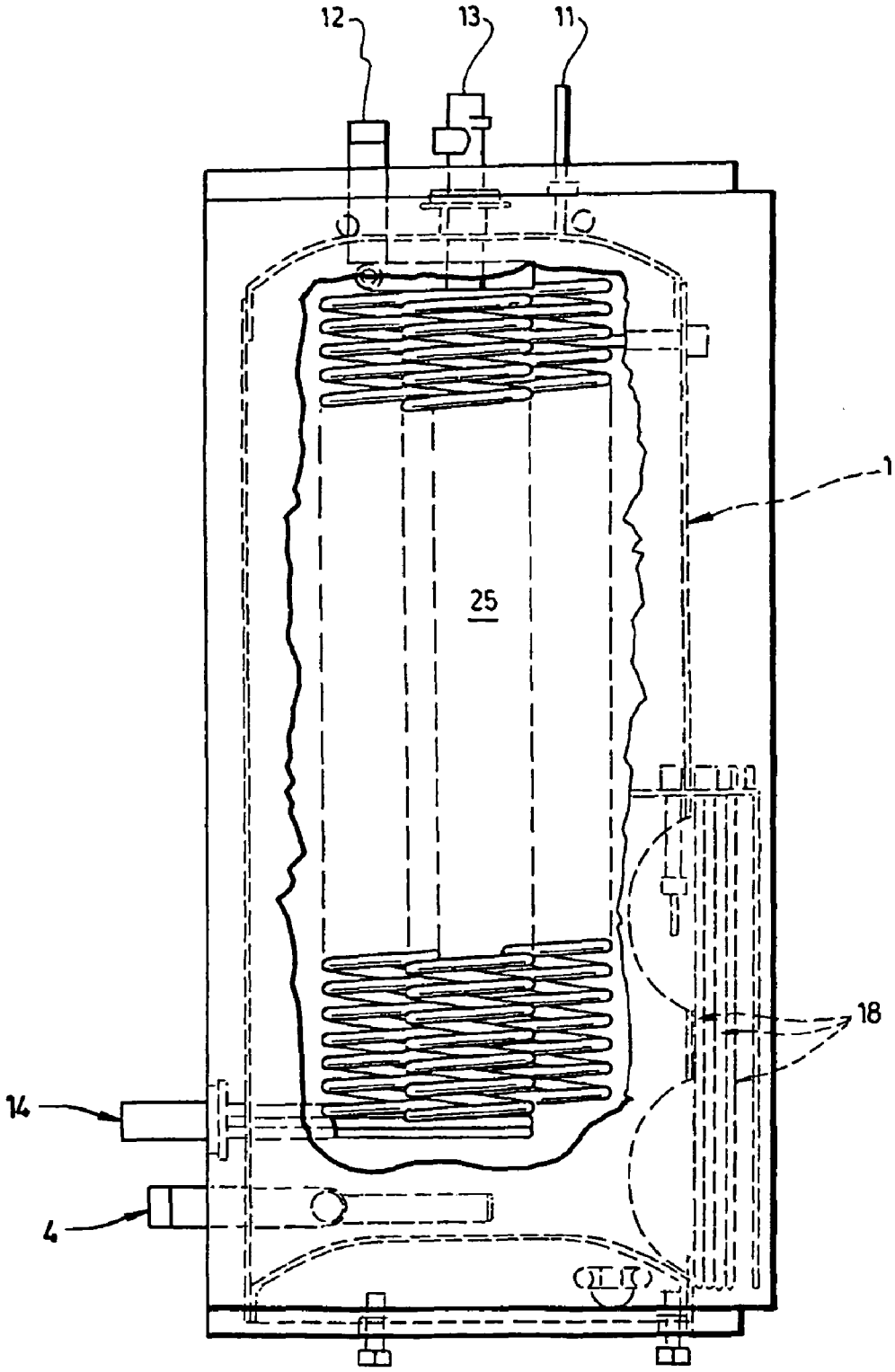
Figure 4:
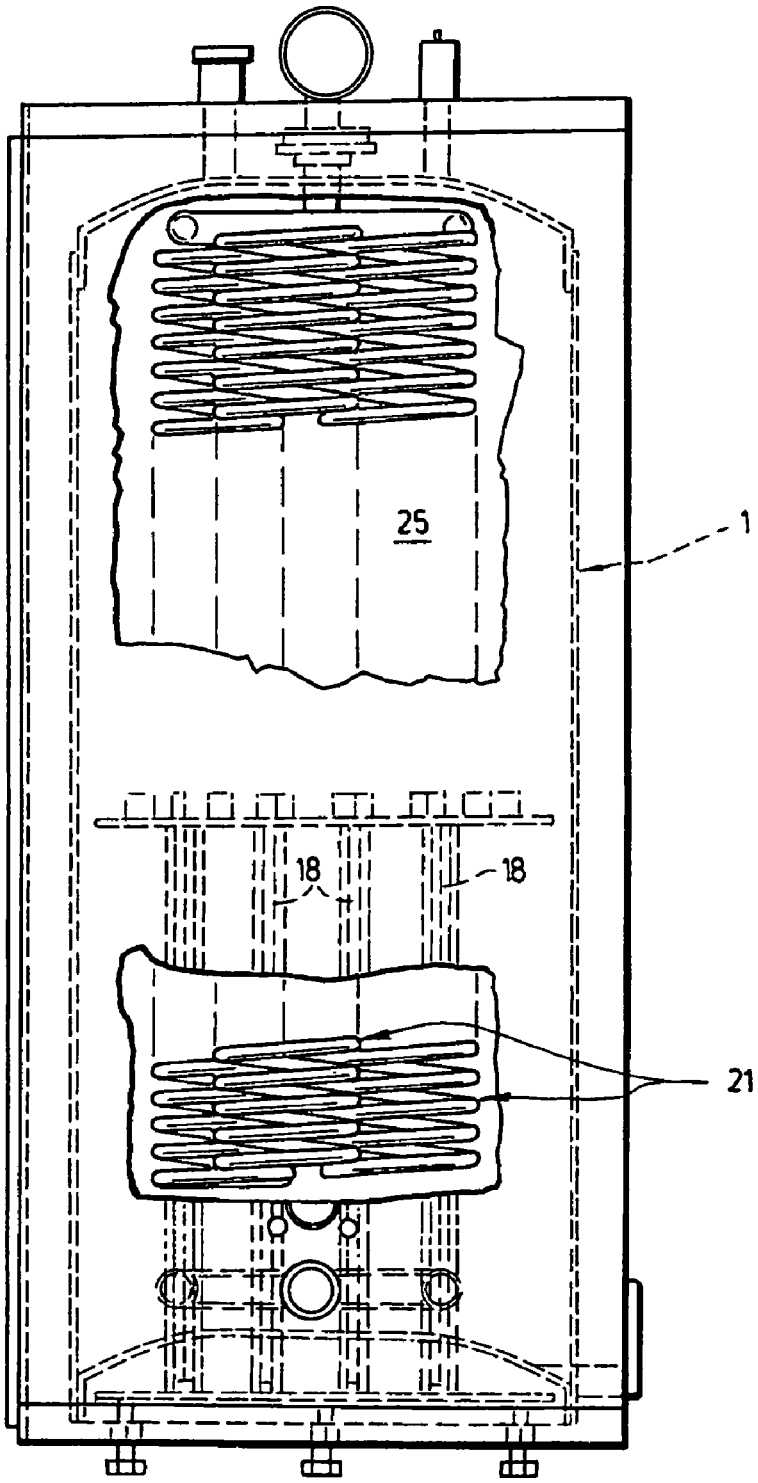
Figure 5:
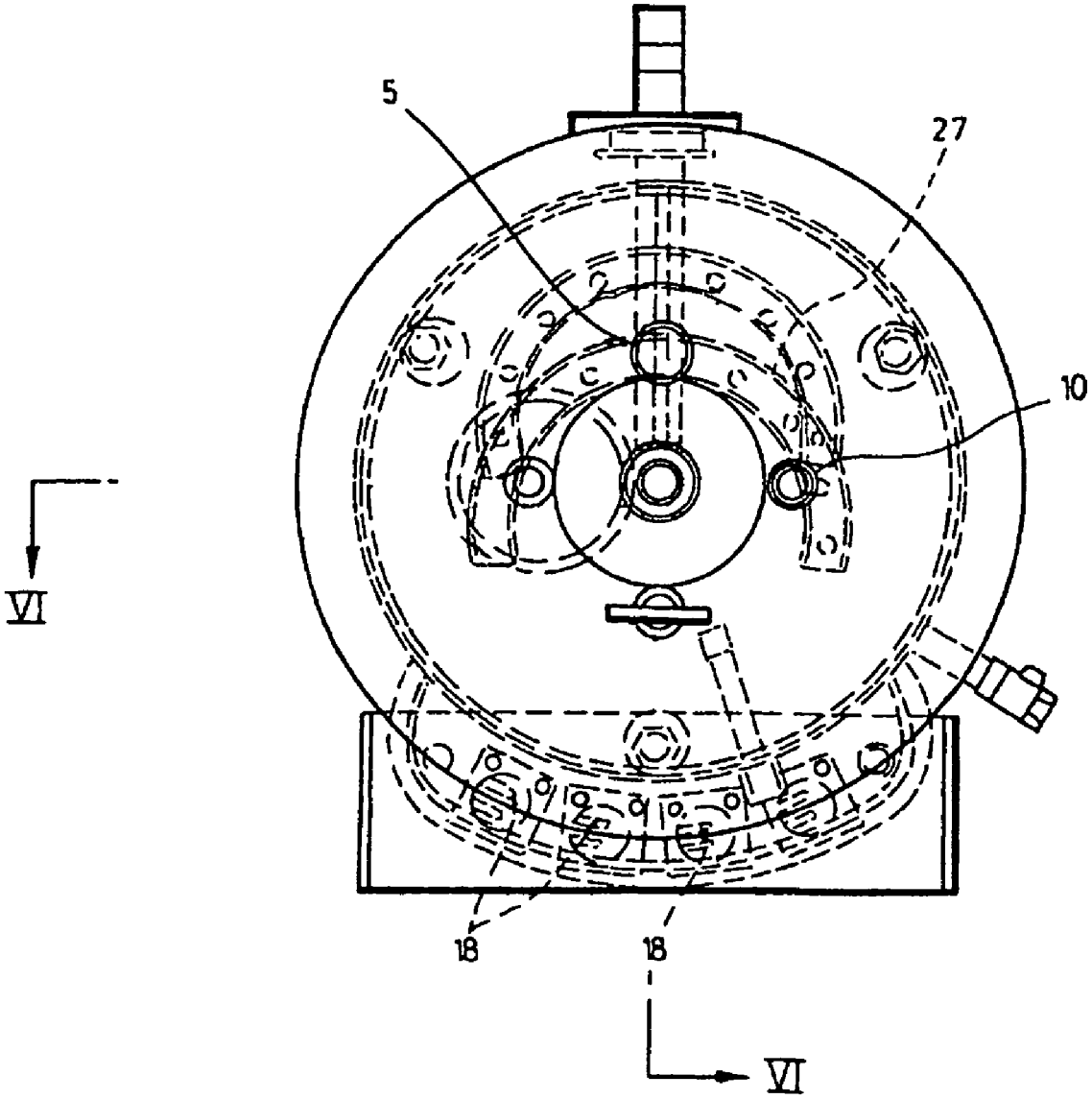
FIGS. 5 and 6 are views similar to those of FIGS. 2 and 4, wherein the basic structural elements of the boilers are identified with numbers.
Figure 6:
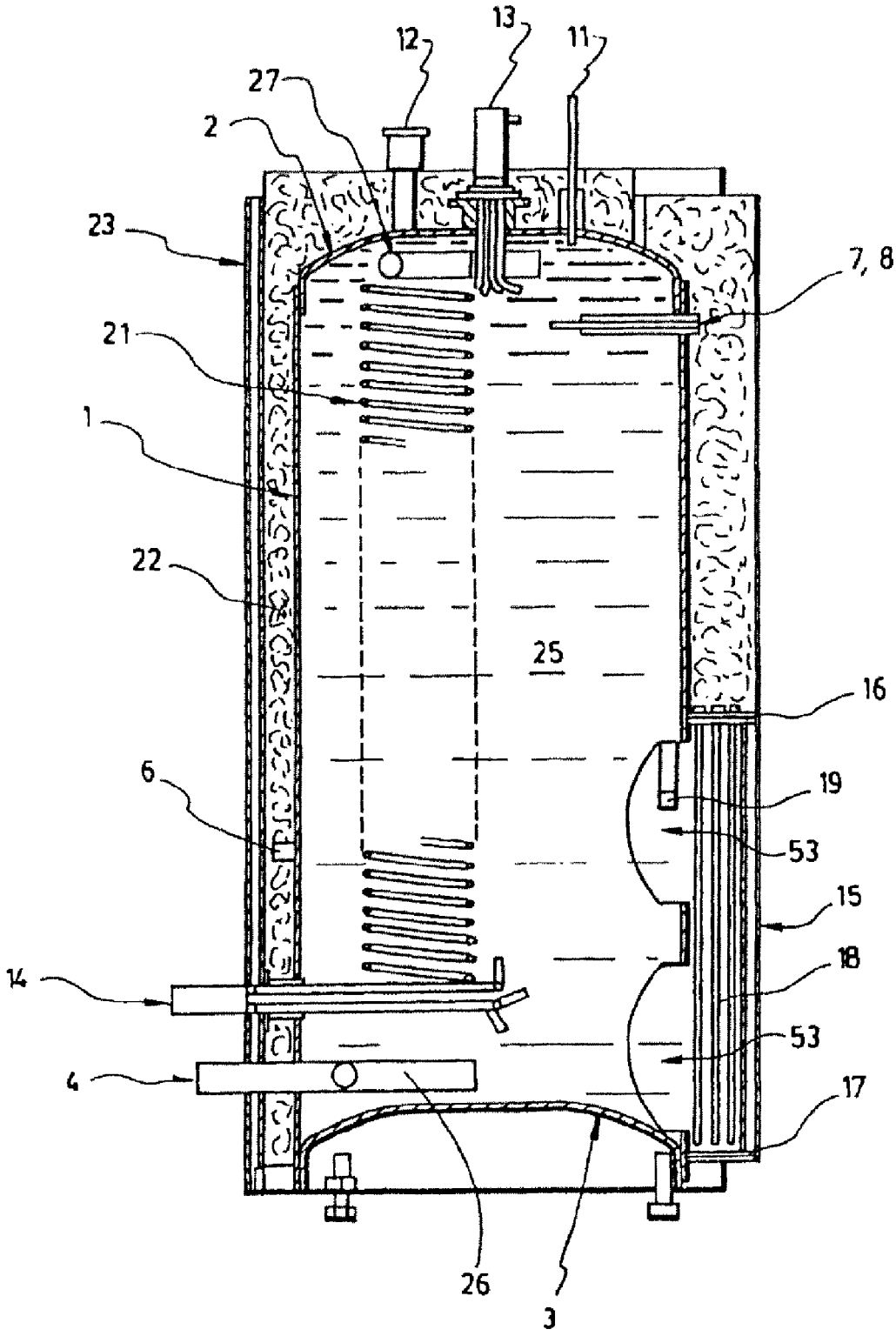

The boiler according to the preferred embodiment of the invention as shown in the accompanying drawings comprises a heating tank made of a steel cylinder (1), a steel lower head (3) and a steel upper head (2). The heating water (25) is located within the heating tank. The volume of the heating tank may vary from 10 to 100 imperial gallons. The heating tank is, in practice, capable of operating at the pressure of 150 psi. It comprises connections (4) and (5) for the entrance of the heating water via an injector (26) and its exit via a receptor (27). These injector and receptor are advantageously of a structure and operation similar to those described in Canadian patent No. 2,038,520.

The cylinder (1) of the heating tank comprises a plurality of other openings in which elements are connected. In addition to the opening which is connected to the water injector (26), the cylinder comprises an opening (6) which is connected to a temperature sensor. This opening is located at one third of the height of the heating tank. Another opening permits insertion of a well for aquastats control. A further opening permits insertion of a well (8) to control limitation of high temperature and another further opening is used for a connection bride between the heating tank and an external exchanger. The lower part of the cylinder also comprises openings (53) permitting circulation of water between the internal part of the cylinder of the heating tank and an adjacent chamber which will be described hereinafter in greater detail.

The lower head (3) of the heating tank does not comprise any opening. The upper head (2) of this tank however contains some openings in which are installed an air vent (12), a temperature/pressure gauge (11) and a pressure relief valve (10) in addition, of course, to the upper receptor (27) and to the connection bride between the heat exchanger and the upper head (2).

The adjacent chamber of the boiler is made of a cylinder (15) welded to the heating tank. It also comprises a lower head (17), curved or flat, and an upper head (16), also curved or flat. The lower head does not comprise any opening. The upper head however comprises openings to insert electrical elements (18) or a gas or oil burner, as well as a temperature probe (19).

A heat exchanger for heating domestic water is mounted within the heating tank. This exchanger comprises a plurality of hollow coils of helicoidal shape (21) that are made of copper and assembled within the heating chamber in a compact manner, as disclosed in the above-mentioned Canadian patent No. 2,038,520.

The heat exchanger is assembled in such a manner as its coils (21) are overlapping each other. All the coils are connected to an inlet and outlet of domestic water via single connection (13, 14). The number of coils varies between 3 to 10 depending on the volume of the heating tank and the maximal operation pressure of operation is of 150 psi.

Advantageously, the external surface of the heating chamber is insulated by means of wool or an insulating foam (22). The whole body may be covered with a steel covering (23) painted with epoxy.

Figure 7:
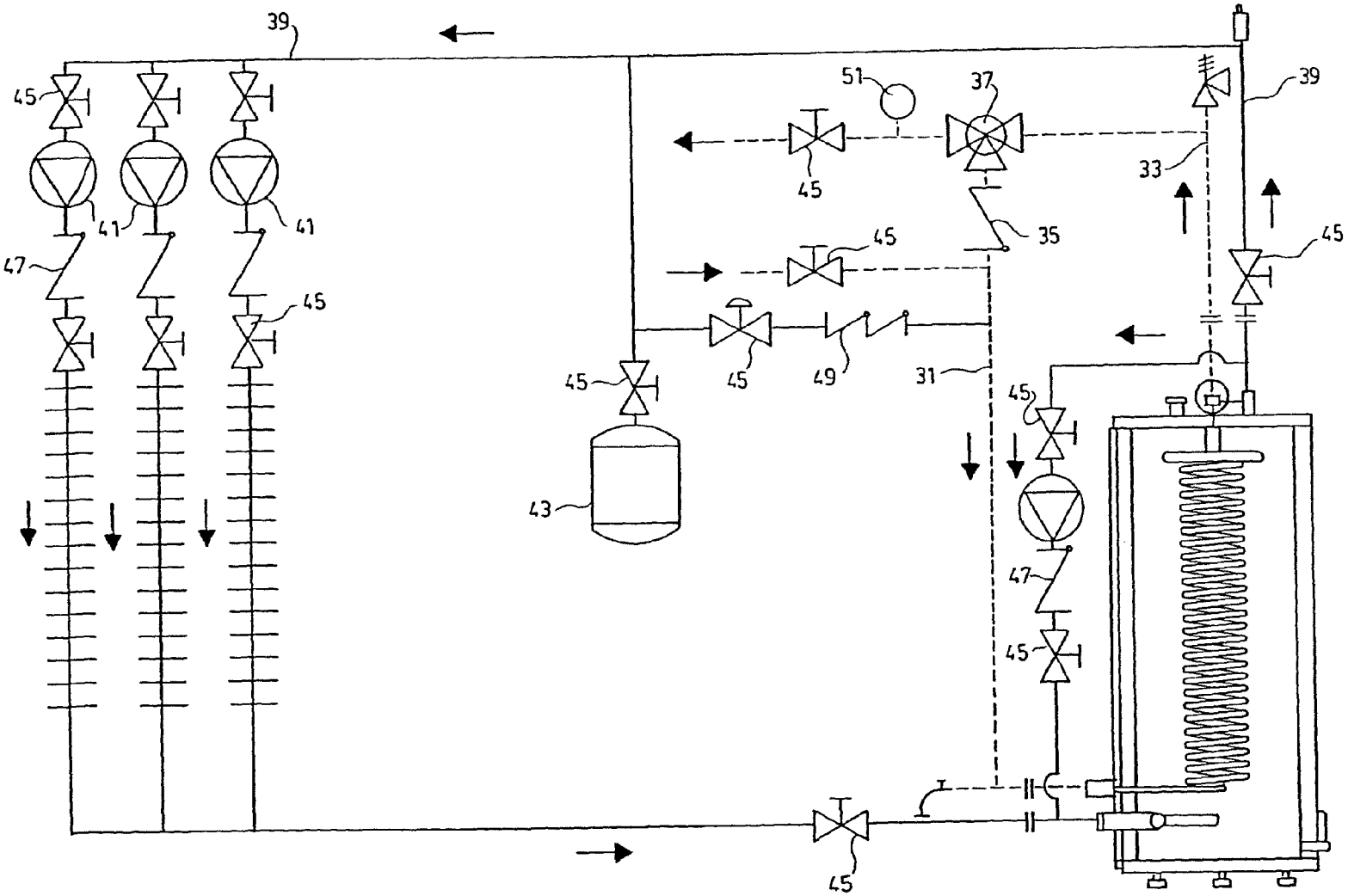
FIG. 7 is a scheme illustrating the way the boiler illustrated in FIGS. 1 to 6 can be installed and used in a building.

Tests have been carried out on a prototype of the boiler disclosed hereinabove in an installation system as illustrated in FIG. 7. In this Figure:

line 31 illustrates the conduct of alimentation of domestic cold water to the boiler;

line 33 illustrates an alimentation conduct of domestic hot water generated with the boiler. This conduct is connected to the conduct 31 via a flow check valve 35 and a thermostatic mixing valve 37 which permits to produce mixed domestic hot water; and line 39 illustrates a primary heating circuit, which comprises supplied conducts of heating water associated to pumps 41, and which also comprises an expansion tank 43.

In the same FIG. 7:

the elements numbered 45 are maintenance valves;

the elements numbered 47 are flow check valves;

the element numbered 49 is a back flow preventer; and the element number 51 is a pressure gauge.

The tests that have been carried out with this installation system have proved to be very interesting and have confirmed the great efficiency of the boiler according to the invention.

It is obvious that modifications could be made to this preferred embodiment without departing from the scope of the present invention.

The invention claimed is:

1. A boiler for providing hot water to a heating system of a building and for simultaneously producing hot domestic water, said boiler comprising:

a heating tank provided with a water inlet and a water outlet through which water for use in the heating system circulates;

means for heating water within the heating tank; and a heat exchanger provided with a water inlet and a water outlet through which the domestic water circulates, said heat exchanger comprising a plurality of tubular coils of helicoidal shape that are located within the heating tank in order to allow heat transfer between hot water within the heating tank and the domestic water that circulates within the tubular coils, wherein said boiler also comprises an adjacent chamber annexed to a lower part of the heating tank, said adjacent chamber containing said means for heating water and being in direct fluid communication with the heating tank via an opening located between the adjacent chamber and the heating tank so as to take advantage of natural convection within said heating tank, wherein the adjacent chamber and the heating tank share a common wall, and wherein the opening located between the adjacent chamber and the heating tank is placed in the common wall.

2. The boiler according to claim 1, wherein the water inlet of the heating tank is devised for (i) injecting part of the water to be heated into the adjacent chamber such that a turbulence is created within said adjacent chamber so as to ensure heat transmission from the adjacent chamber toward the heating tank, (ii) ensuring uniform diffusion of water within the heating tank and (iii) generating turbulences of said water within the heating tank around the tubular coils;

wherein the water outlet of the heating tank is provided with a receiver; and wherein the heat exchanger extends over almost all of a height of the heating tank in order to get maximum energy by heat transfer.

3. The boiler according to claim 1, wherein said means for heating the water within the heating tank operates with electricity, oil, gas or solar panels.

4. The boiler according to claim 1, further comprising a temperature probe located at a bottom of the heating tank for starting a pump that circulates water from the bottom to a top of said heating tank when such is necessary.

5. The boiler according to claim 1, wherein said means for heating the water within the heating tank are electrical elements inserted into the adjacent chamber.

6. The boiler according to claim 2, wherein said means for heating the water within the heating tank are electrical elements inserted into the adjacent chamber.

7. The boiler according to claim 2, wherein said means for heating the water within the heating tank operates with electricity, oil, gas or solar panels.

8. The boiler according to claim 2, further comprising a temperature probe located at a bottom of the heating tank for starting a pump that circulates water from the bottom to a top of said heating tank when such is necessary.

9. The boiler according to claim 3, further comprising a temperature probe located at a bottom of the heating tank for starting a pump that circulates water from the bottom to a top of said heating tank when such is necessary.

10. The boiler according to claim 5, further comprising a temperature probe located at a bottom of the heating tank for starting a pump that circulates water from the bottom to a top of said heating tank when such is necessary.

11. The boiler according to claim 6, further comprising a temperature probe located at a bottom of the heating tank for starting a pump that circulates water from the bottom to a top of said heating tank when such is necessary.

12. The boiler according to claim 1, wherein the opening located between the adjacent chamber and the heating tank is positioned along the common wall of the heating tank at non-zero distances away from the water inlet of the heating tank and the water outlet of the heating tank.

13. A boiler for providing hot water to a heating system of a building and for simultaneously producing hot domestic water, comprising:

a heating tank provided with a first water inlet and a first water outlet and configured such that water for use in the heating system circulates;

a heating source configured to heat water within the heating tank;

a plurality of tubular coils configured such that the domestic water circulates, the tubular coils being of helicoidal shape and located within the heating tank, the plurality of tubular coils being connected to a second water inlet and a second water outlet, the plurality of tubular coils being configured such that heat transfer occurs between hot water within the heating tank and the domestic water that circulates within the tubular coils; and an adjacent chamber annexed to a lower part of the heating tank, wherein the adjacent chamber contains the heating source and is in direct fluid communication with the heating tank via an opening located between the adjacent chamber and the heating tank so as to take advantage of natural convection within said heating tank, wherein the adjacent chamber and the heating tank share a common wall, and wherein the opening located between the adjacent chamber and the heating tank is placed in the common wall.

14. The boiler according to claim 13, wherein the first water inlet is configured such that turbulence of said water within the heating tank is generated around the tubular coils, and wherein the first water outlet is provided with a receiver.

15. The boiler according to claim 13, wherein the heating source is configured to operate with electricity, oil, gas or solar panels.

16. The boiler according to claim 13, further comprising a temperature probe located at a bottom of the heating tank for starting a pump configured to circulate water from the bottom to a top of said heating tank.

17. The boiler according to claim 13, wherein the heating source comprises electrical elements inserted into the adjacent chamber.

18. The boiler according to claim 13, wherein the opening between the adjacent chamber and the heating tank is positioned along the common wall of the heating tank at non-zero distances away from the first water inlet of the heating tank and the first water outlet of the heating tank.

19. The boiler according to claim 1, wherein the adjacent chamber is in direct fluid communication with the heating tank only at the lower part of the heating tank.

20. The boiler according to claim 13, wherein the adjacent chamber is in direct fluid communication with the heating tank only at the lower part of the heating tank.

* * * * *